US008366345B1

(12) United States Patent
Copeland

(10) Patent No.: US 8,366,345 B1
(45) Date of Patent: Feb. 5, 2013

(54) POWERED SCREED MACHINE

(76) Inventor: Henry Copeland, Montgomery, AL (US)

( * ) Notice: Subject to any disclaimer, the term of this patent is extended or adjusted under 35 U.S.C. 154(b) by 0 days.

(21) Appl. No.: 12/806,508

(22) Filed: Aug. 16, 2010

(51) Int. Cl.
*E01C 19/38* (2006.01)
*E01C 19/22* (2006.01)

(52) U.S. Cl. ..... 404/114; 404/120

(58) Field of Classification Search ..... 404/114, 404/118, 120, 75, 124, 133.05, 133.1, 133.2, 404/101, 103, 117, 122, 119; 74/86, 87
See application file for complete search history.

(56) References Cited

U.S. PATENT DOCUMENTS

| | | | | | |
|---|---|---|---|---|---|
| 2,048,071 | A | * | 7/1936 | Jacobson | 404/75 |
| 2,761,079 | A | * | 8/1956 | Giertz-Hedstrom et al. | 310/82 |
| 3,067,656 | A | * | 12/1962 | Gustafsson | 404/114 |
| 3,096,984 | A | * | 7/1963 | Garrison | 239/687 |
| 3,266,233 | A | * | 8/1966 | Farrall | 477/16 |
| 3,368,466 | A | * | 2/1968 | Rowe | 404/119 |
| 3,548,998 | A | * | 12/1970 | Heller | 198/468.9 |
| 4,340,351 | A | * | 7/1982 | Owens | 425/456 |
| 4,386,901 | A | * | 6/1983 | Morrison | 425/456 |
| 4,466,757 | A | * | 8/1984 | Allen | 404/114 |
| 4,830,534 | A | * | 5/1989 | Schmelzer et al. | 404/117 |
| 4,838,730 | A | * | 6/1989 | Owens | 404/114 |
| 6,224,293 | B1 | * | 5/2001 | Smith | 404/117 |
| 6,302,619 | B2 | * | 10/2001 | Fix | 404/84.1 |
| 6,976,805 | B2 | | 12/2005 | Quenzi et al. | |
| 7,018,133 | B2 | | 3/2006 | Peterson | |
| 7,052,204 | B2 | | 5/2006 | Lutz | |
| 7,153,058 | B2 | | 12/2006 | Lindley | |
| 7,175,365 | B1 | | 2/2007 | Breeding | |
| 7,407,339 | B2 | | 8/2008 | Halonen et al. | |
| 7,491,011 | B2 | | 2/2009 | Quenzi et al. | |
| 7,651,296 | B2 | | 1/2010 | Lindley | |
| 7,658,667 | B2 | | 2/2010 | Thysell et al. | |
| 2002/0044832 | A1 | * | 4/2002 | Fix | 404/120 |

* cited by examiner

*Primary Examiner* — Thomas B Will
*Assistant Examiner* — Abigail A Risic
(74) *Attorney, Agent, or Firm* — Rodgers & Rodgers

(57) ABSTRACT

A powered screed machine comprising means to drive a screed blade and means to power machine travel. The machine includes a pair of elongated modules disposed perpendicular to each other whereby a reciprocating weight within one of the modules causes forward and rearward movement of the machine and a reciprocating weight in the other module causes vibratory movement of the screed blade to groom the surface of freshly poured concrete.

7 Claims, 18 Drawing Sheets

POWERED SCREED MACHINE

BACKGROUND OF THE INVENTION

The present invention is in the field of powered screeds used in the process of leveling, smoothing and creating an improved exposed surface on freshly poured concrete, cement, soil and like materials. Although the present invention is utilized in connection with many materials, the embodiment shown and described herein is directed to concrete. The word concrete includes a mixture of cement, sand, aggregate and water combined in a favorable ratio to create a product useful in the construction of floors, roads, driveways, sidewalks and the like. Concrete also embodies a mixture combined and mixed to a proper consistency and in a state of cure prior to set-up or hardening.

In the process of pouring concrete for floors, sidewalks, highways and the like, the exposed surface must be developed to a finished texture as required by the work specifications. This may vary from a rough nonslip surface to a slick polished finish. This is achieved by a process known as screeding. This process brings a tool into contact with the surface of the poured concrete, and by a reciprocating, dragging action causes the aggregate near and at the surface to settle thereby leaving cement and water exposed while, at the same time, leveling and smoothing the exposed surface material.

In one screeding system, common to the industry, an elongated wood beam or screed of sufficient length is manipulated in a side-to-side sawing motion along pairs of supporting rails temporarily set at the desired finished elevation of the surface being poured. This side-to-side motion is combined with pressure against the beam to force travel along the supporting rails. In this system, all power is applied manually by workmen positioned at opposite ends of the beam.

On larger areas, such as highway lanes and large floors, the typical process utilizes a screed provided with means to mechanically power both the sawing motion and travel along the guiding rails with travel being implemented by powered traction wheels.

A third system, in current use in the industry, includes a screed beam, power means to effect side-to-side sawing motion, a guide with a controlling handle and a frame on which all of the elements are mounted. This system commonly utilizes one operator in the fashion of a push-type lawnmower with the operator causing the machine to travel by applying a push or pull force to the machine handle.

BRIEF SUMMARY OF THE INVENTION

By this invention, a powered screed machine is provided which comprises power means fixed to a support frame together with a machine control system. The machine includes a screed weight module disposed parallel to the axis of the screed blade with a travel weight module disposed perpendicular thereto and being generally coaxially disposed with respect to the direction of travel of the machine.

DETAILED DESCRIPTION OF THE INVENTION

Figure 1:
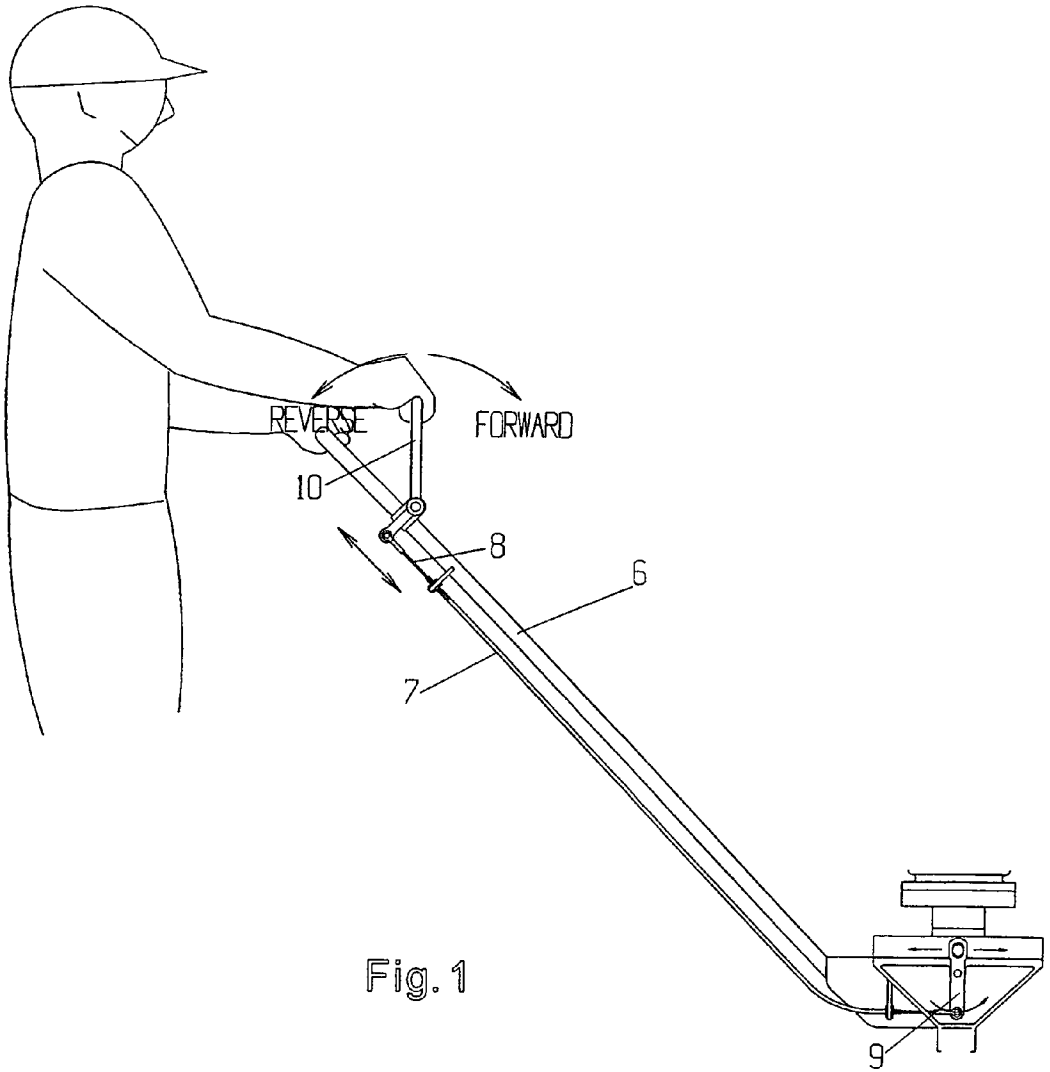
FIG. 1 is a side elevational view showing the control elements of the powered screed machine according to this invention.
Figure 2B:
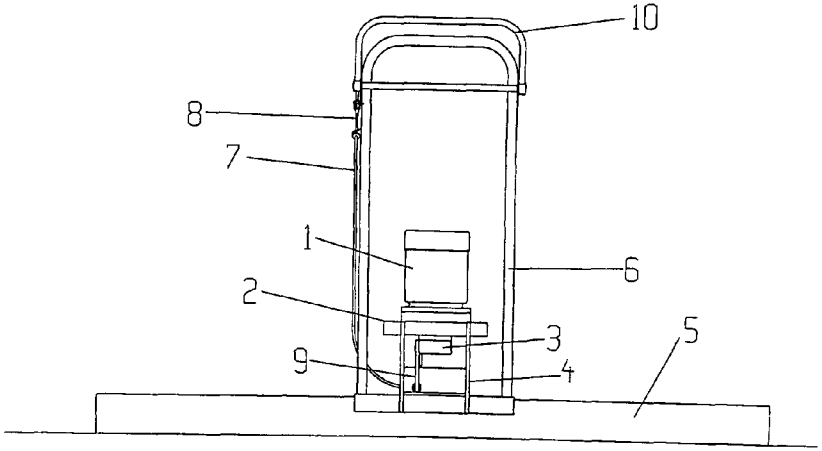
FIG. 2B is an elevational view taken generally from the right side of FIG. 2A.
Figure 2A:
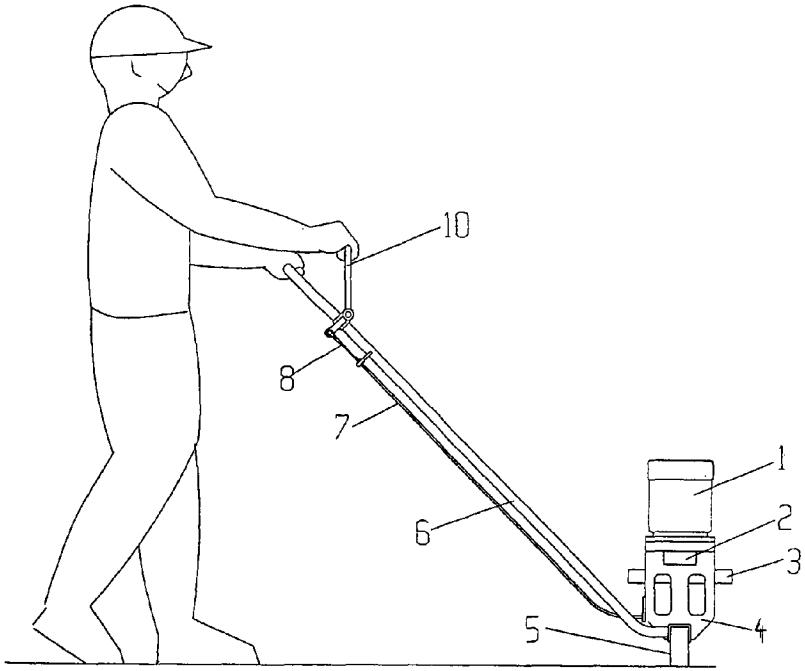
FIG. 2A is a view similar to FIG. 1.
Figure 4A:
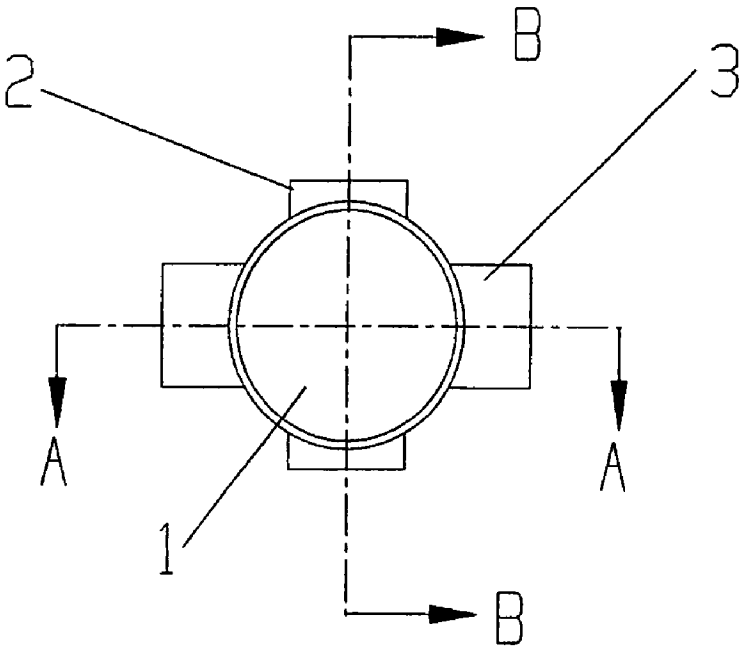
FIGS. 4A, 4B and 4C show top, end and side views of the machine control elements, respectively.
Figure 3:
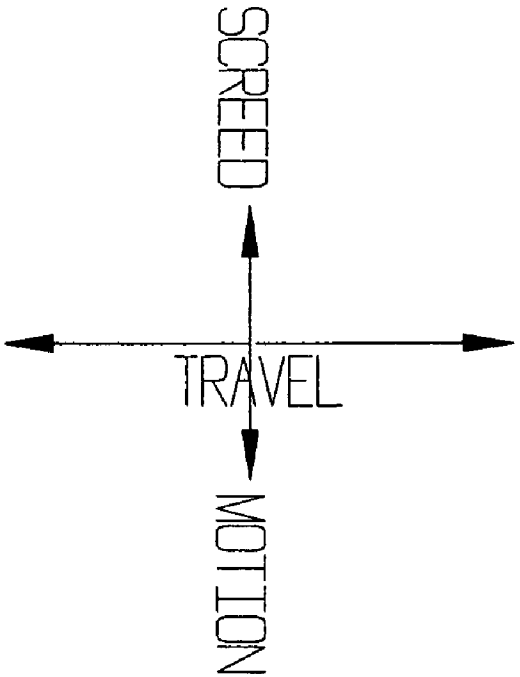
FIG. 3 is a graphical representation showing the combination of reciprocatory movement in the direction of travel of the machine in combination with operation of the screed blade.
Figure 4C:
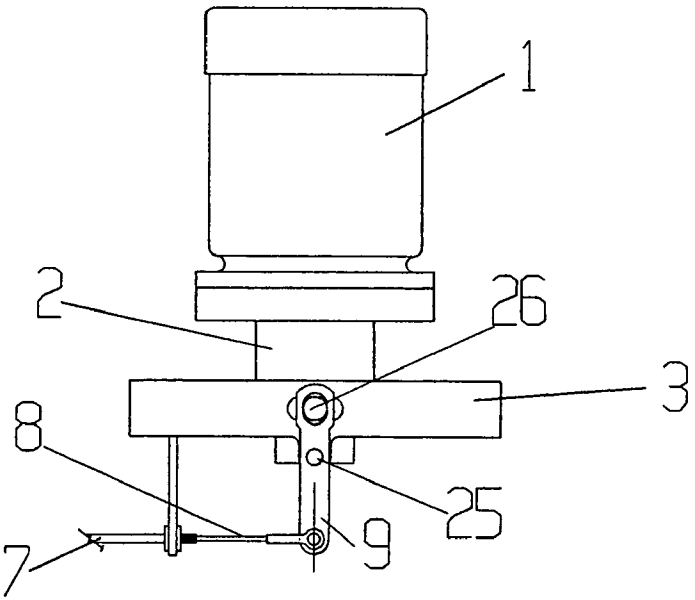
Figure 4B:
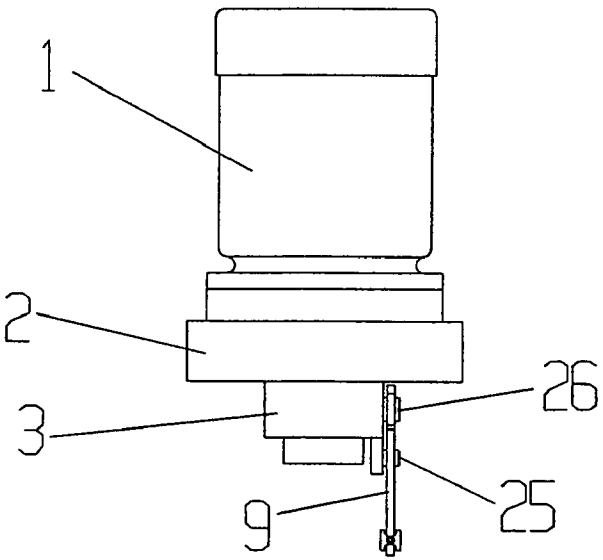
Figure 4E:
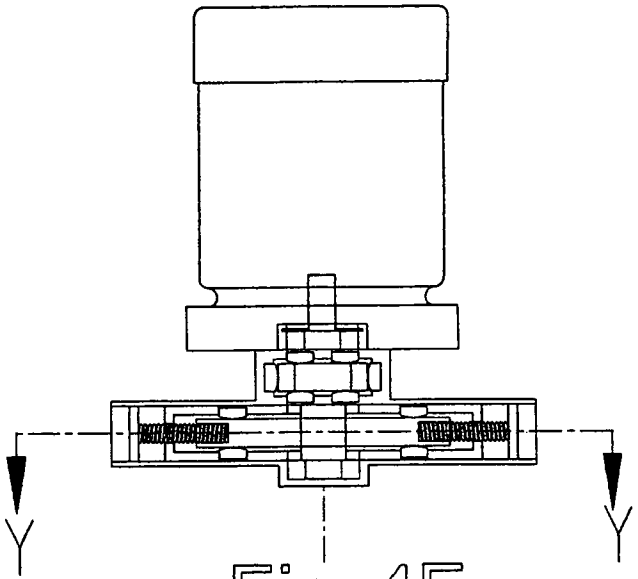
FIG. 4E is a sectional view taken along the line A-A in FIG. 4A.
Figure 4D:
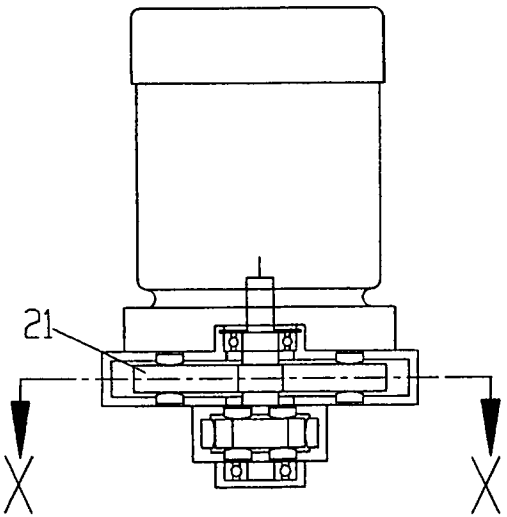
FIG. 4D is a sectional view taken along the line B-B in FIG. 4A.

With particular reference to FIG. 2B, the screed machine according to this invention includes power means 1, screed-axis weight module 2, travel-axis weight module 3, support frame 4, elongated screed blade 5 and handle frame 6. The machine control system includes control cable housing 7, control cable 8, travel control arm 9 and control lever 10.

During operation, the machine is held in an upright position by the operator with screed blade 5 disposed essentially normal to the surface being processed. With power means 1 operating, screed blade 5 is driven in a reciprocating left to right motion by means of screed-axis weight module 2. Also, the machine is caused to reciprocate in a direction perpendicular to the screed reciprocating direction by means of travel-axis weight module 3. Travel-axis weight module 3 is designed and constructed to selectively generate a force of variable intensity and in a reversible direction with respect to the machine direction of travel. The operator positions control handle 10 to effect travel forward and reverse along the surface being processed.

Figure 5B:
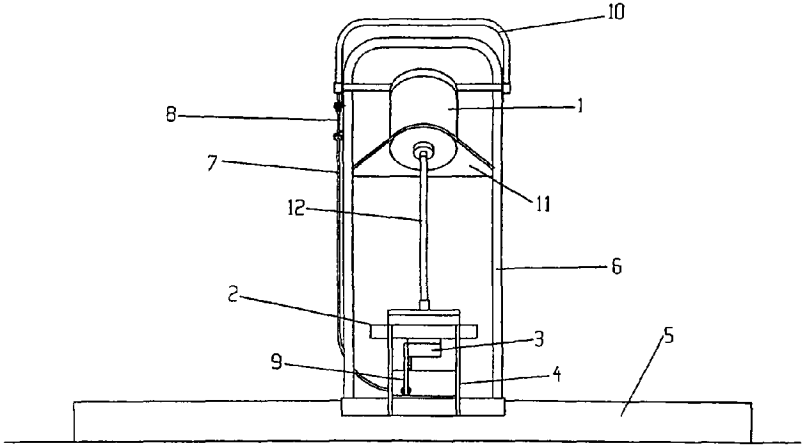
FIGS. 5A and 5B are similar to FIGS. 2A and 2B, respectively, and show a modification of the invention.
Figure 5A:
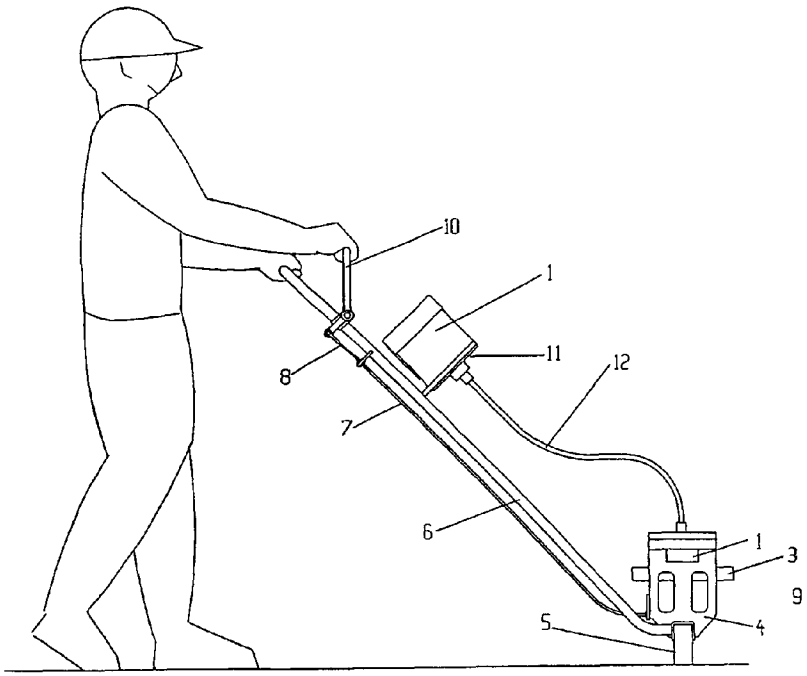
Figure 6A:
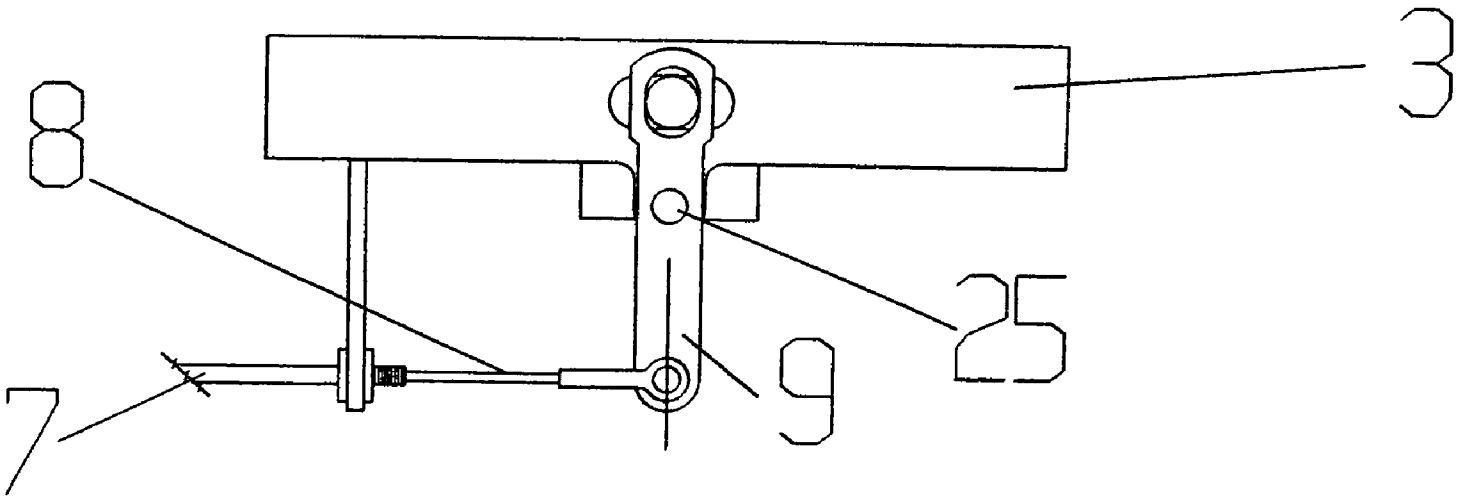
FIG. 6A is a side view of a portion of the machine control mechanism.
Figure 6B:
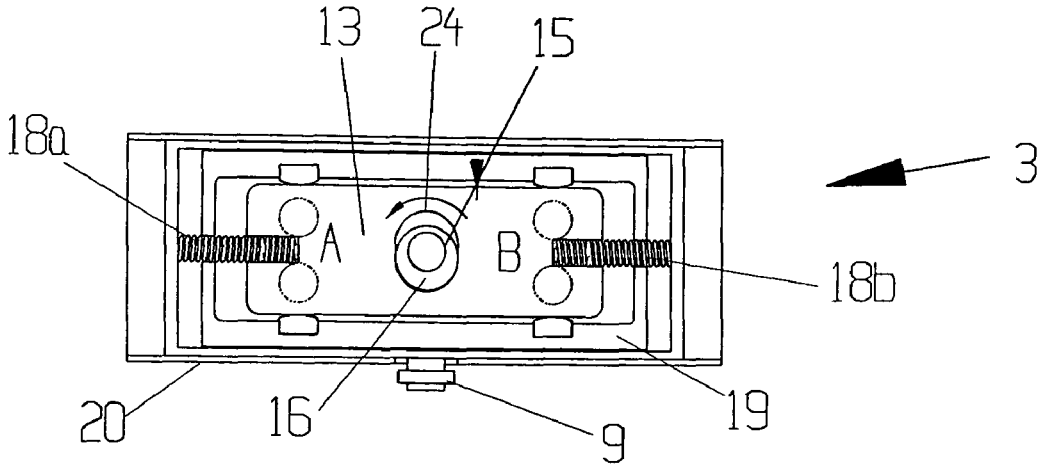
FIGS. 6B-6E are sectional views taken along the line Y-Y in FIG. 4E.
Figure 6C:
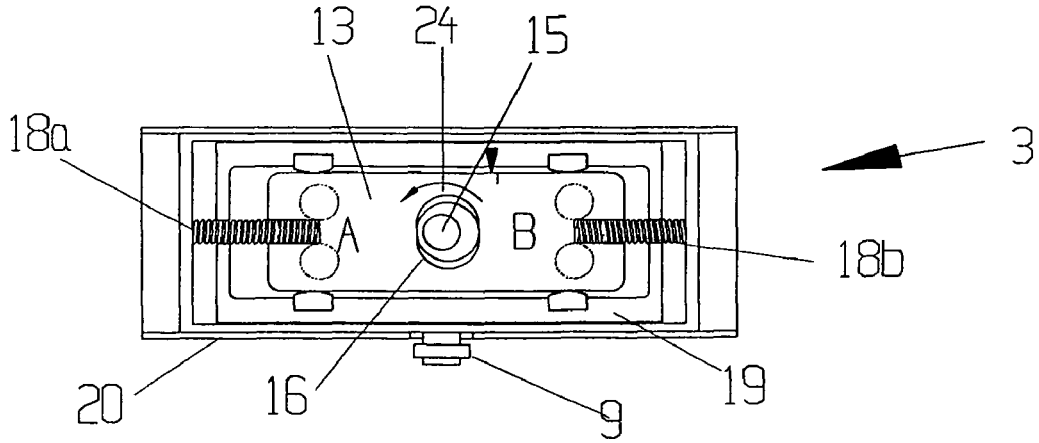
Figure 6D:
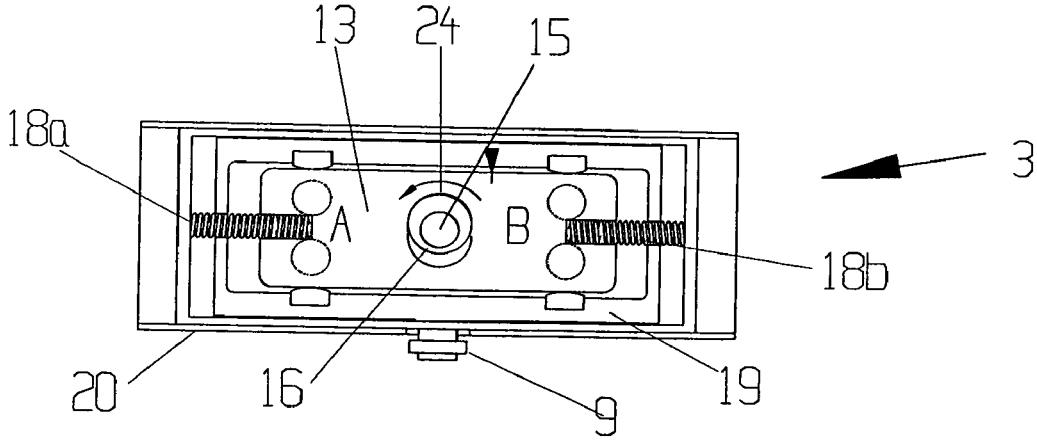
Figure 6E:
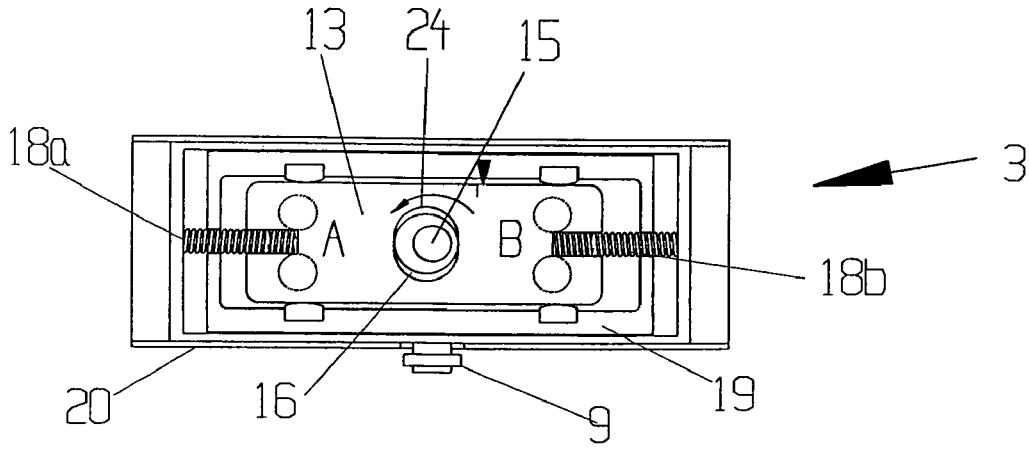

In FIGS. 5A and 5B, an alternate embodiment of the machine is shown whereby power means 1 is located remotely on handle frame 6 and is supported by power means mount 11. Power is transmitted to drive shaft 15 through flexible drive linkage 12.

With reference to FIGS. 8A-8F, screed-axis weight module 2 is provided with screed weight 21 which is driven by shaft 15 in combination with eccentric cam 22 wherein the axis of cam 22 is offset from the axis of shaft 15. Weight 21 is supported and guided during travel by screed weight housing 23 and weight guide bushings 14. Shaft 15 is rotated by power means 1. The elongation of slot 24 perpendicular to the travel direction of weight 21 allows rotation of shaft 15 and eccentric cam 22 to effect movement of weight 21 only in the direction of the screed axis. As weight 21 is driven in a reciprocating motion by eccentric cam 22, the inertial force produced by the reciprocation of weight 21 is applied through the combination of eccentric cam 22, shaft 15, shaft bearing 17 and support frame 4 to screed blade 5.

Vibratory conveyors which move material in one direction operate on a principle well known in the art. The structural surface of the machine which contours the material being conveyed is moved in both the direction of material flow and in the opposite direction by means of a reciprocating weight connected to the supporting surface. Movement of conveyed material in the desired direction is effected by causing the reciprocating weight to be greater in magnitude in one direction than in the other. This is accomplished by applying a bias force to the weight in the form of a spring. As the weight is moved against the spring, its acceleration is decreased and energy thus expended is transferred to the compressed spring. As the motion reverses, stored energy in the spring is released thereby increasing the acceleration of the weight in the reverse direction. Therefore, during each cycle of reciprocation of the weight, the machine surface moves at a greater rate in one direction than the other, thereby moving the conveyed material in the desired direction.

With reference to FIGS. 9A-9E, travel-axis weight module 3 is provided with travel weight 13 and elongated slot 24. Eccentric cam 16 is mounted on and fixed to shaft 15 with the shaft being rotatably driven by power means 1. Springs 18*c* and 18*d* are attached to spring frame 20 and to weight 13. Elongation of slot 24 crosswise to the machine travel direction allows the rotation of shaft 15 and eccentric cam 16 to effect movement to weight 13 only along the axis of travel of weight 13. Weight 13 is supported and guided by weight guide 19 and weight guide bushings 14. If the combination of forces causes the machine to veer off line, weight 13 can be angled with respect to the direction of machine travel to counteract these forces and maintain the desired direction of travel of the machine.

As shown in FIGS. 6A-6E, travel-axis weight 13 is attached to springs 18*a* and 18*b* with the opposite ends of the springs attached to spring frame 20. The motion of travel of weight 13 causes the compression of spring 18*b* thereby resulting in storage of energy in spring 18*b*. As shaft 15 and eccentric cam 16 continue to rotate energy stored in spring 18*b* is released to accelerate weight 13 to the left as it moves toward spring 18*a*.

The continued rotation of shaft 15 and eccentric cam 16 causes the same force to be applied to spring 18*a* as was applied to spring 18*b* during the first 180 degrees of rotation. As shaft 15 and eccentric cam 16 rotate, there is a cyclic storage and release of energy in springs 18*a* and 18*b*. During rotation of shaft 15 and eccentric cam 16, spring frame 20 acts to maintain springs 18*a* and 18*b* in the same relative position from the central axis of the mechanism thereby causing the storage and release of energy to be equal and symmetrical with respect to the central axis.

With reference to FIGS. 7A-7E, travel-axis weight module 3 is provided with spring frame 20 slidably mounted with respect to frame 4, weight guide 19 and shaft 15. The sliding motion of spring frame 20 is effected by the leverage force applied to arm 9 by control cable 8. Arm 9 is pivotably mounted on pin 25 and pin 25 is fixed to frame 4. Extension and retraction of control cable 8, acting upon arm 9, causes spring frame 20 to change its position relative to frame 4, shaft 15, eccentric cam 16, weight 13 and springs 18*c* and 18*d*. Specifically, spring frame 20 is caused to move closer to spring 18*c* by the retraction of control cable 8 acting on arm 9. The location of spring frame 20 in this position causes spring 18*c* to have a shorter compressed length during all phases of the rotation cycle. This location of spring frame 20 also causes spring 18*d* to have a longer compressed length during the same phases of rotation cycle. The result of this difference in effective spring lengths is an imbalance of force on weight 13 and the accompanying imbalance of acceleration due to storage and release of spring energy during all phases of the rotation cycle.

Figure 7A:
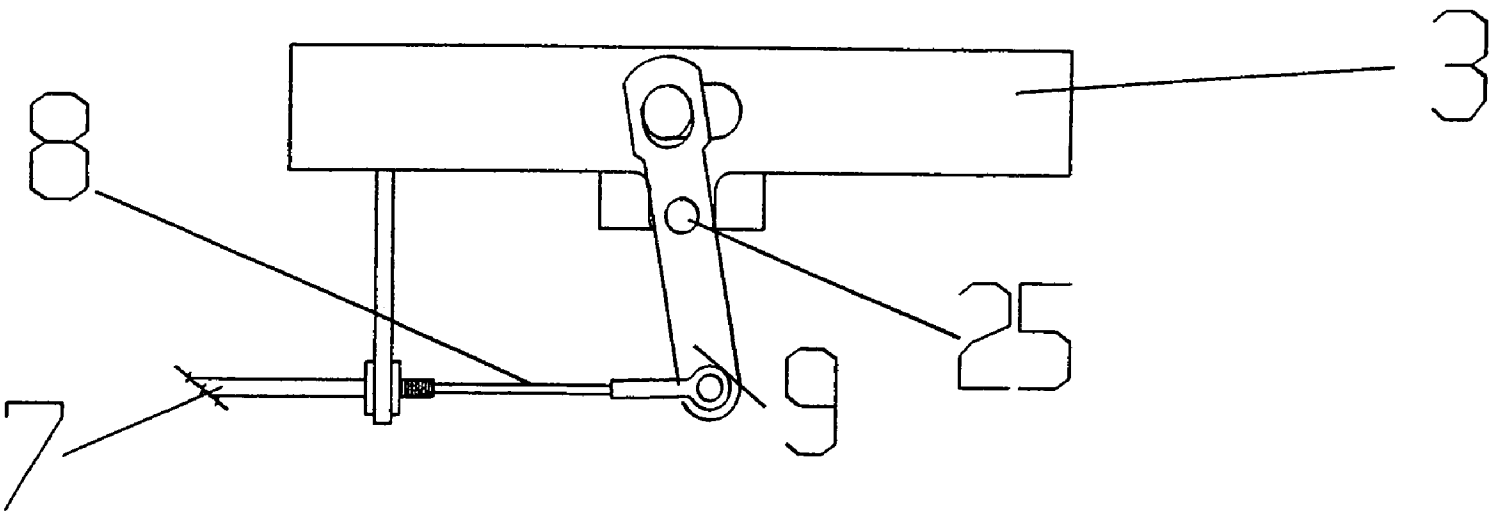
FIGS. 7A-7E are views similar to FIGS. 6A-6E, respectively.
Figure 7B:
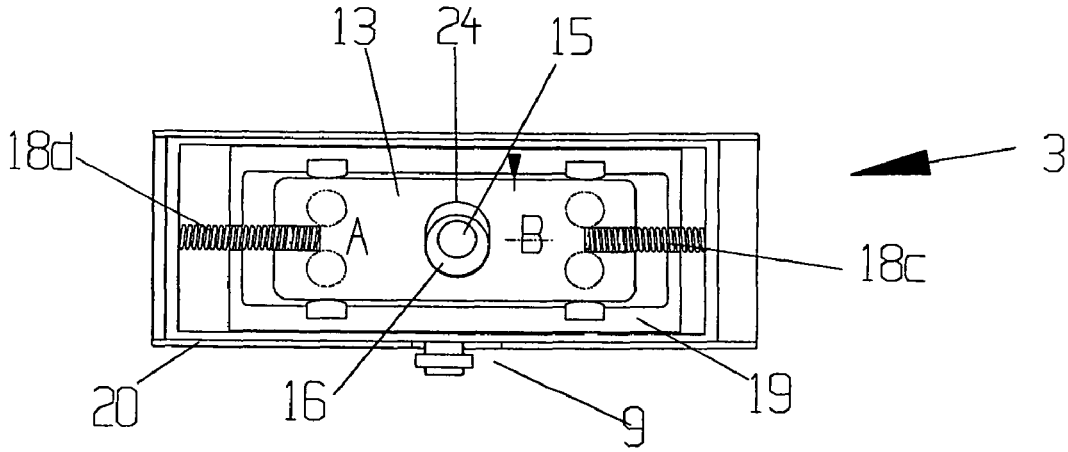
Figure 7C:
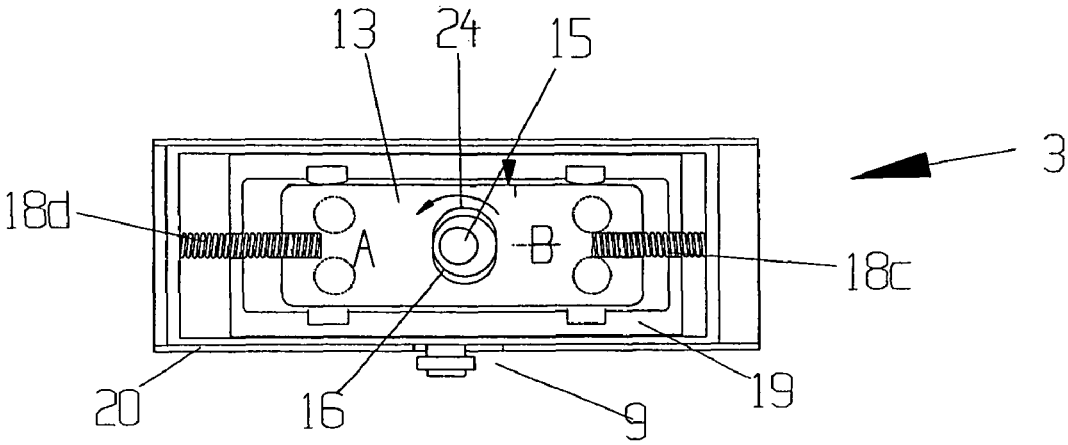
Figure 7D:
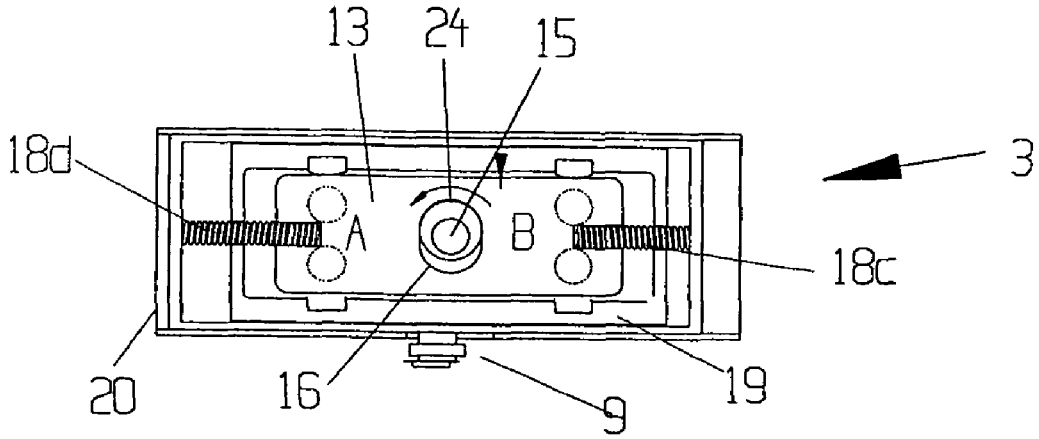
Figure 7E:
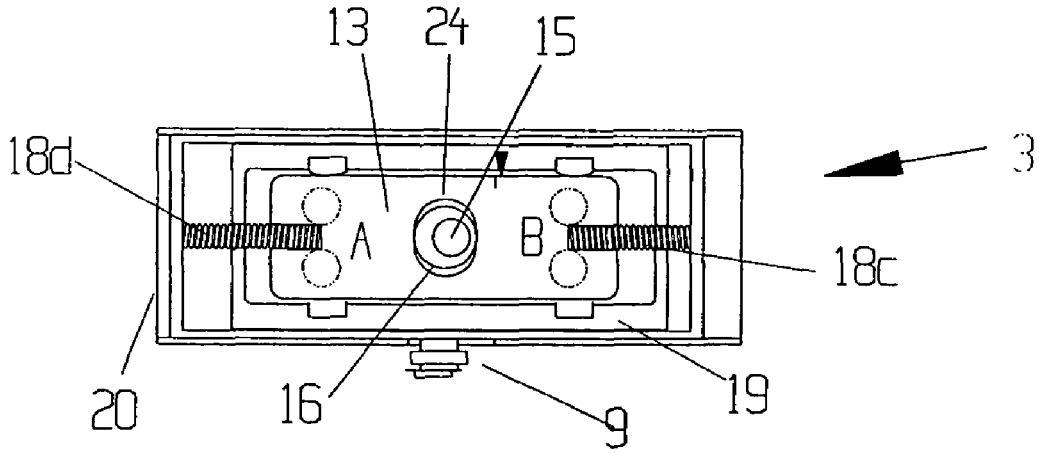
Figure 8A:
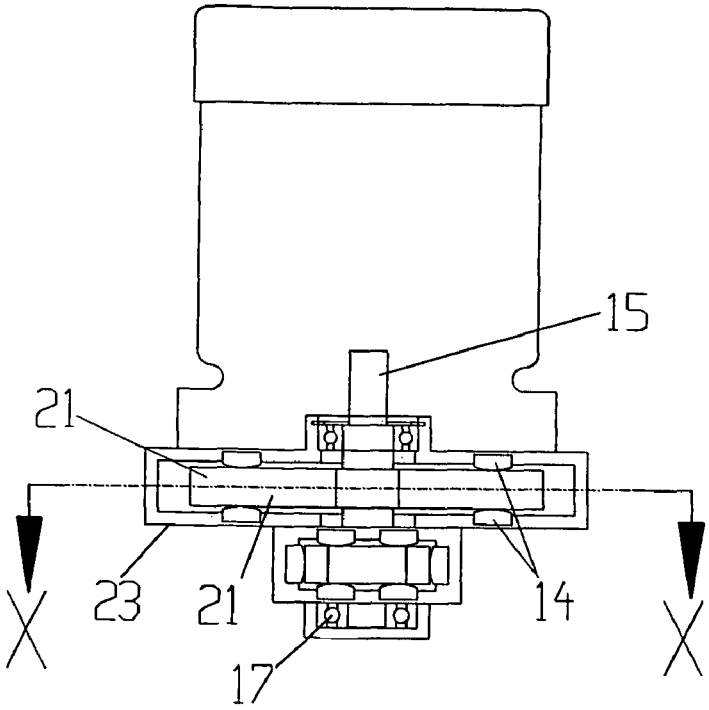
FIG. 8A is an elevational of the machine with a portion thereof broken away.
Figure 8B:
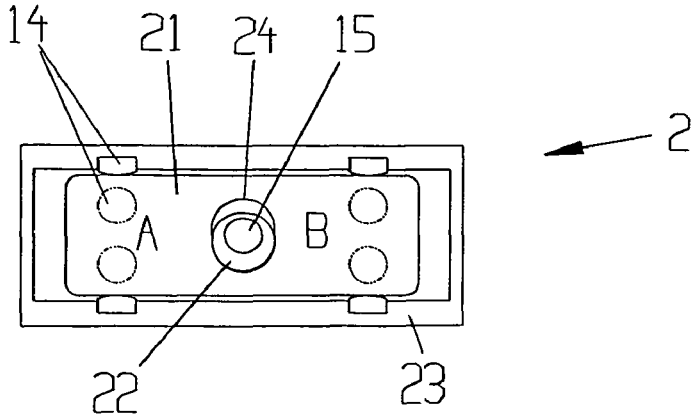
FIGS. 8B-8F are sectional views taken along the line X-X in FIG. 4D and FIG. 8A.
Figure 8C:
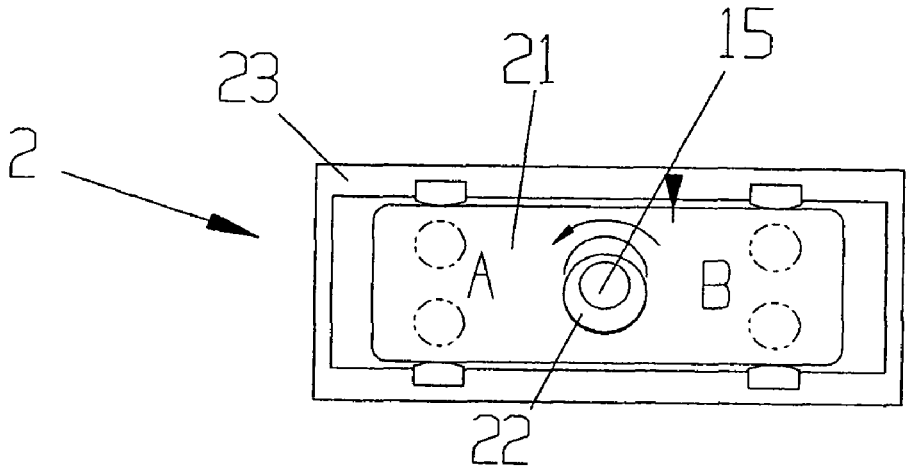
Figure 8D:
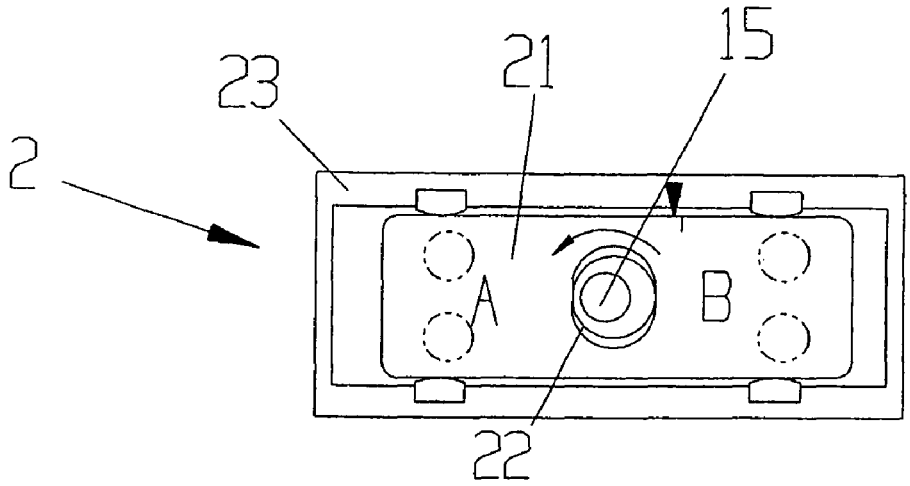
Figure 8E:
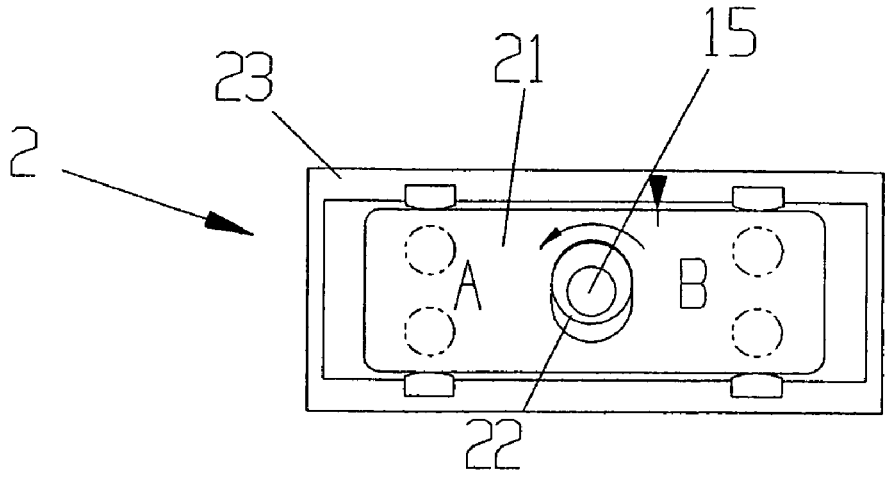
Figure 8F:
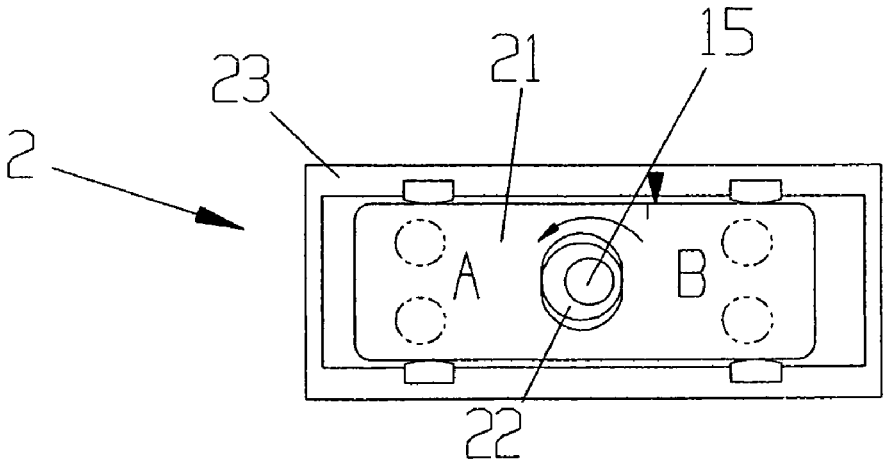
Figure 9A:
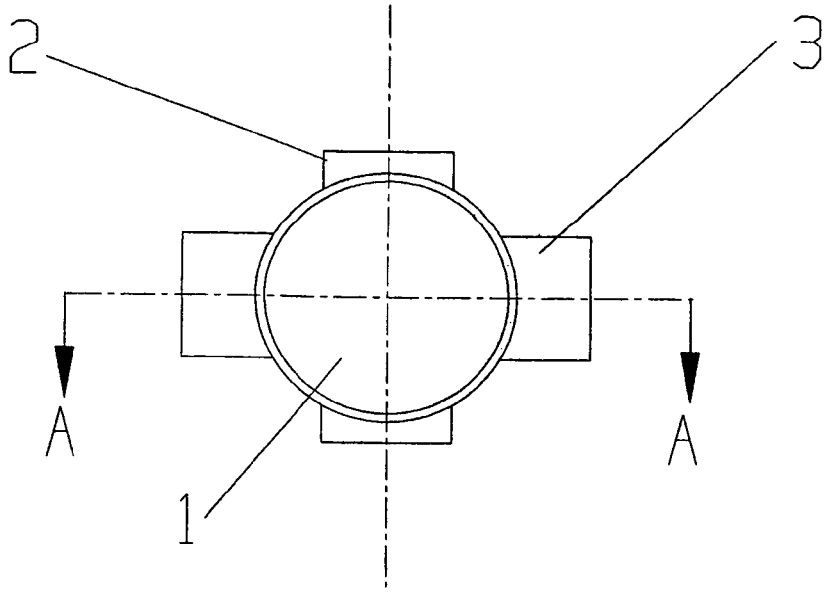
FIG. 9A is a schematic top view of the machine.
Figure 9B:
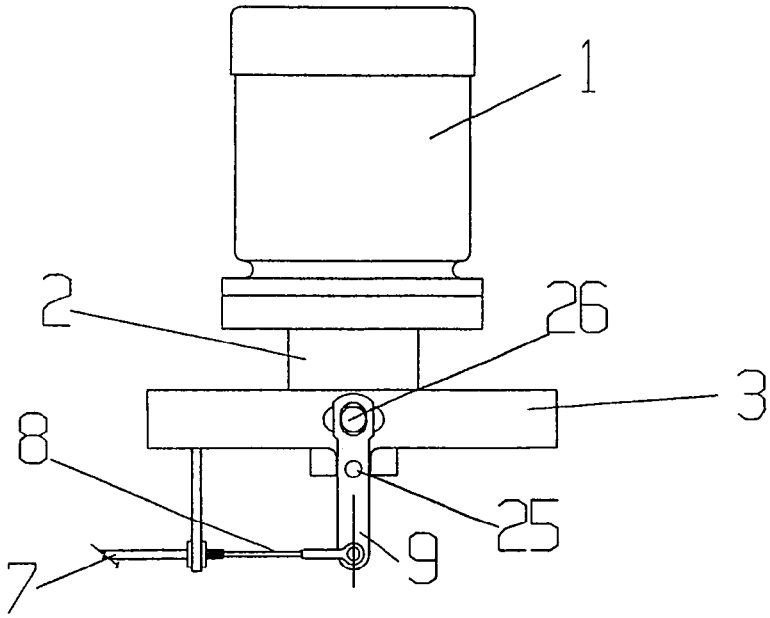
FIG. 9B is a side view of the machine control elements.
Figure 9C:
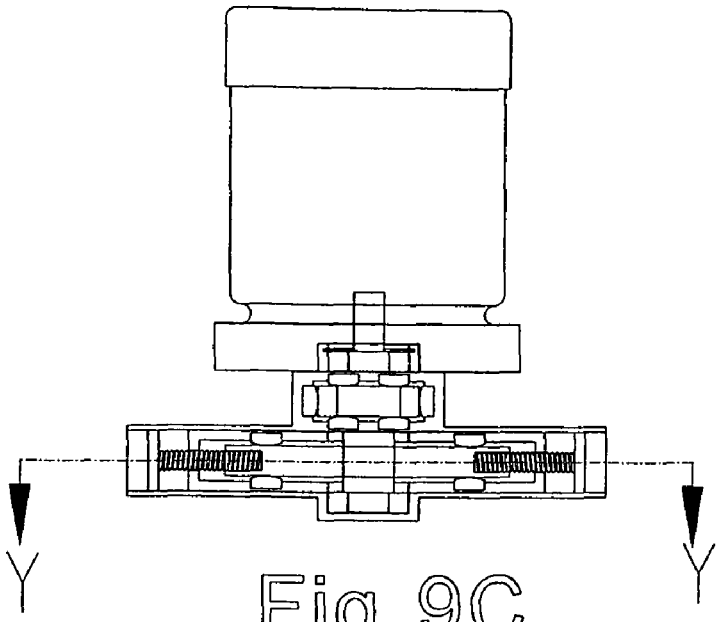
FIG. 9C is a partial sectional view of the machine.
Figure 9D:
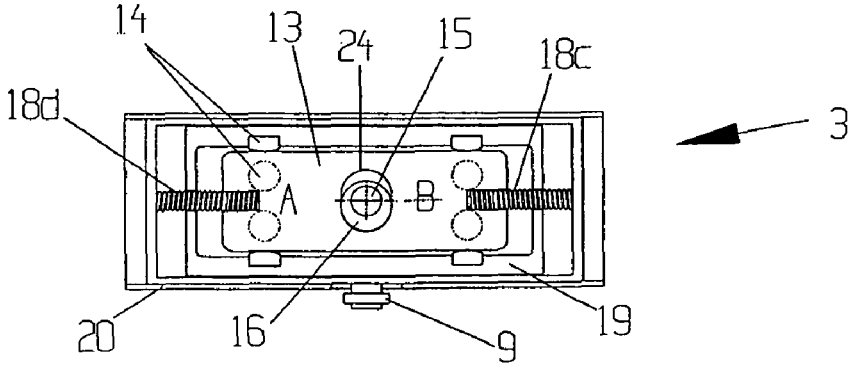
FIGS. 9D and 9E are sectional views taken along the line Y-Y in FIG. 9C.
Figure 9E:
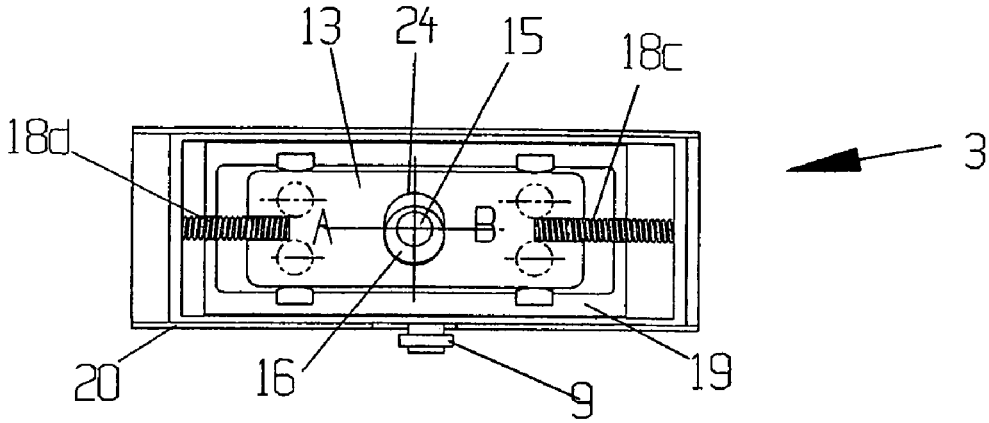

During rotation of eccentric cam 16 from the position shown in FIG. 7C to that shown in FIG. 7E, the energy stored in spring 18*c* is released and is combined with the force provided by eccentric cam 16 to enhance the acceleration of weight 13 as it moves toward spring 18*d*. Since spring 18*d* has a longer compressed length, less energy is absorbed from weight 13 during this phase of rotation of cam 16.

An imbalance of accelerating forces across weight 13 during movement from the position in FIG. 7C to the position in FIG. 7E results in travel-axis weight 13 being driven at a greater velocity during travel from spring 18*c* toward spring 18*d* than during travel from spring 18*d* toward spring 18*c*. Hence, weight 13 applies a net force on frame 4, through springs 18*c* and 18*d*, spring frame 20, eccentric cam 16 and shaft 15 that is greater in the direction from side B to side A than from side A to side B. This net force difference causes the machine to travel in a direction from side B toward side A. Reversing the direction of control handle 10 to cause control cable 8 to extend and reverse the position of arm 9 will move spring frame 20 in the opposite direction and thereby reverse the direction of machine travel in proportion to the extent of movement of control handle 10.

The invention claimed is:

1. A screed machine comprising a support frame, a machine control system associated with said machine, a screed blade interconnected to said frame, a screed-axis weight module operatively interconnected to said screed blade, said screed-axis weight module comprising a screed weight disposed within a screed weight housing, an elongated slot formed in said screed weight perpendicular to the travel direction of said screed weight, an eccentric cam disposed in said elongated slot formed in said screed weight to impart reciprocating motion to said screed weight, a travel-axis weight module comprising a travel weight disposed within a weight guide, an elongated slot formed in said travel weight perpendicular to the travel direction of said screed machine, an eccentric cam disposed in said elongated slot formed in said travel weight to impart reciprocating motion to said travel weight, said weight guide disposed within a spring frame, a pair of springs attached respectively to opposite ends of said travel weight and to said spring frame, and said travel-axis weight module operatively interconnected to said machine and comprising said spring frame slideable with respect to said support frame to simultaneously increase the compression of one of said springs and decrease the compression of the other of said springs.

2. A screed machine according to claim 1 wherein said travel-axis weight module comprises a spring frame slidably mounted on said frame.

3. A screed machine according to claim 2 wherein said spring frame is slidable by means of manipulation of said machine control system.

4. A screed machine according to claim 3 wherein said spring frame is selectively positionable to cause one of said springs to have a shorter compressed length than the compressed length of the other of said springs.

5. A screed machine according to claim 1 wherein said travel cam is rotatable by power means mounted on said frame.

6. A screed machine according to claim 5 wherein a rotatable shaft interconnects said power means and said travel cam and the axis of said travel cam is offset from the axis of said shaft.

7. A screed machine according to claim 1 wherein said travel weight is horizontally adjustable.

* * * * *